United States Patent [19]

Magnan

[11] Patent Number: 4,856,447

[45] Date of Patent: Aug. 15, 1989

[54] FLEX WING APPARATUS

[75] Inventor: Jeffrey J. Magnan, San Clemente, Calif.

[73] Assignee: Gaastra Sails International Limited, Hong Kong

[21] Appl. No.: 47,089

[22] Filed: May 8, 1987

Related U.S. Application Data

[63] Continuation-in-part of Ser. No. 594,476, Mar. 28, 1984, Pat. No. 4,686,921, and Ser. No. 647,549, Sep. 5, 1984, Pat. No. 4,708,079.

[51] Int. Cl.[4] ..... B63H 9/06

[52] U.S. Cl. ..... 114/103; 114/39.2; 114/102

[58] Field of Search ..... 114/102–104, 114/108, 90, 97–99, 39.1, 39.2; 441/74

[56] References Cited

U.S. PATENT DOCUMENTS

| | | | |
|---|---|---|---|
| 721,286 | 2/1903 | Couch | 114/39.1 |
| 737,118 | 8/1903 | Laughlin | 114/39.1 |
| 2,077,685 | 4/1937 | Gerhardt | 114/103 |
| 2,484,687 | 10/1949 | Jr. | 114/103 |
| 2,561,253 | 7/1951 | Wells-Coates | 114/102 |
| 2,569,318 | 9/1951 | Kersten | 114/103 |
| 2,589,203 | 3/1952 | Nilsen | 114/103 |
| 2,608,172 | 8/1952 | Biuw | 114/103 |
| 3,141,435 | 7/1964 | Moffitt, Jr. | 119/39.1 |
| 3,147,729 | 9/1964 | Barnard | 114/108 |
| 3,173,395 | 3/1965 | Laurent | 114/39.1 |
| 3,310,017 | 3/1967 | Dyer | 114/98 |
| 3,331,348 | 7/1967 | Dyer | 114/90 |
| 3,371,636 | 3/1968 | Sharp | 114/39.1 |
| 3,593,356 | 7/1971 | Schmalfeldt | 114/39.1 |
| 3,693,571 | 9/1972 | Hiscock | 114/102 |
| 3,768,426 | 10/1973 | Kratz | 114/39 |
| 3,795,215 | 3/1974 | Butler | 114/90 |
| 3,835,804 | 9/1974 | Jackson | 114/107 |
| 3,841,251 | 10/1974 | Larson | 114/39.1 |
| 3,866,558 | 2/1975 | Bergstrom | 114/90 |
| 3,877,406 | 4/1975 | Davis | 114/39.1 |
| 3,882,810 | 5/1975 | Roeser | 114/112 |
| 4,016,823 | 4/1977 | Davis | 114/90 |
| 4,064,821 | 12/1977 | Roberts et al. | 114/103 |
| 4,149,482 | 4/1979 | Hoyt | 114/106 |
| 4,230,060 | 10/1980 | McCoy | 114/39.1 |
| 4,267,790 | 5/1981 | Hood | 114/106 |
| 4,335,669 | 6/1982 | Hackney | 114/103 |
| 4,388,888 | 6/1983 | Gushurst | 114/90 |
| 4,418,631 | 12/1983 | Frohbach | 114/39.1 |
| 4,463,699 | 8/1983 | Lineback | 114/39.1 |
| 4,479,451 | 10/1984 | Lucht | 114/104 |
| 4,593,638 | 6/1986 | Cochraron | 114/39.2 |
| 4,625,671 | 12/1986 | Nishimura | 114/103 |
| 4,649,848 | 3/1987 | Belvedere | 114/103 |

FOREIGN PATENT DOCUMENTS

| | | | |
|---|---|---|---|
| 384075 | 10/1923 | Fed. Rep. of Germany | 114/102 |
| 2658772 | 7/1978 | Fed. Rep. of Germany | 114/102 |
| 3003529 | 8/1981 | Fed. Rep. of Germany | 114/97 |
| 58-61091 | 4/1983 | Japan | 114/102 |
| 58-61093 | 4/1983 | Japan | 114/102 |
| 8400538 | 2/1984 | Netherlands | 114/102 |
| 2097741 | 11/1982 | United Kingdom | 114/102 |

OTHER PUBLICATIONS

Manfred Curry, pp. 74–75.

(List continued on next page.)

*Primary Examiner*—Joseph F. Peters, Jr.
*Assistant Examiner*—Clifford T. Bartz
*Attorney, Agent, or Firm*—Pollock, Vande Sande & Priddy

[57] ABSTRACT

Flex wing apparatus is disclosed comprising a mast and a sail, the sail having a luff sleeve which receives the mast. Battens in the sail are supported with respect to the mast by means of couplings which prevent the movement of the leading end of the battens against or around the mast, but permit the batten ends to move laterally to either side of the mast as the apparatus switches from one tack to the other. This is accomplished by the use of couplings each having a collar and a leg, and in which the leg is permitted to rotate relative to the collar simultaneously with the collar rotating relative to the mast. Such counter-rotation enables the leading extremity of each batten to move from one side of the mast to the other in a controlled fashion and to engage and support the luff sleeve on the leeward side of the sail on either tack.

29 Claims, 6 Drawing Sheets

OTHER PUBLICATIONS

"Easy Rider", Sails Speed Line Literature; Vertrieb, Hanover, West Germany.

North Sails Advertisement, Wind Surf, Mar., 1984, p. 30.

"The Hi-Tension Wing Sail", Jeffrey Magnan, Wind Surf Jun., 1984, pp. 58-59.

"The Solid Wing", Gary Efferdiny, Wind Surf, Jun. 1984, p. 59.

"Foils-Present & Future", Sailboarder, May 1984, Barry Spanier & Goeffrey Bourne, pp. 22,23.

"Sails-the Optimum Quiver", Bill Whidden, Wind Surfer, May 1984, pp. 64-66.

"The Wing Mast: Vacuum Advance", Clay Feeter, Wind Surfer May 1984, p. 65.

"R & D Capers", Roger Jones, Wind Surf, Jul., 1984, p. 70.

"The Powerfoil is Coming", Freesail, Nov. 1984, cover and one page.

"30K and Beyond Weymouth 1983", Wind Surf, Mar. 1984 Cliff Webb. 6 pages.

FLEX WING APPARATUS

CROSS REFERENCE TO RELATED APPLICATIONS

This Application is a Continuation-In-Part of the present inventor's prior co-pending applications Ser. Nos. 594,476 and 647,549, respectively filed on March 28, 1984 and Sept. 5, 1984, now U.S. Pat. Nos. 4,686,921, issued Aug. 18, 1987 and 4,708,079, issued Nov. 24, 1987, the disclosures of which applications and patents are hereby incorporated by reference.

BACKGROUND OF THE INVENTION

A flex wing apparatus is any apparatus which derives its support or motive power, in whole or in part, from a flexible wing. Examples of flex wing apparatus include sail boats, windsurfers, hang gliders and land sailing apparatus. The flex wing itself can for example, be a sail for a boat together with the associated mast.

The performance of a flex wing apparatus is dependent upon the efficiency of its flex wing. In order to adapt a flex wing for particular wind conditions, the camber of the wing can be adjusted.

In a typical flex wing, resilient battens are carried by batten pockets in the sail, and the shape or camber of the sail is determined by the dimensions and shape of the sail itself, the shape of the mast and the spacing allowed between the mast and the trailing end of battens in the sail. Provision can be made for adjusting these parameters, for example by altering the tension in the leech of the sail, the downhaul tension at the sail luff, or the outhaul tension on the sail. When the camber or curvature of the sail is increased, a forward force is applied to the battens which, unless otherwise resisted, will force the battens against or around the mast.

In my prior applications referred to above, flex wing apparatus are disclosed in which the movement of the leading end of battens in a sail are controlled by couplings between the battens and the mast which ensure that battens cannot advance into direct engagement with or around the mast in a manner which will distort the sail adjacent the mast and thereby adversely affect the performance of the sail.

In many contemporary flex wing apparatus, a sail is formed with a sleeve at its leading or luff edge, and the sail is mounted on the mast by the mast being received in this luff sleeve. As described in my earlier applications referred to above, the couplings thereof can be disposed within such a luff sleeve, with the battens in the sail extending forwardly thereinto. The couplings are connected to the battens proximate the trailing edge of the luff sleeve; i.e., near the line or seam that defines the forward boundary of the single sheet of flex wing material that forms the main body of the sail.

SUMMARY OF THE INVENTION

The present Application is concerned with flex wing apparatus similar to those disclosed in my earlier Applications, but is concerned particularly with the alignment of the leading edges of battens in the sail with the leeward side of the luff sleeve when the apparatus is in use. Particularly, the present application is directed at coupling mechanisms which prevent undesired forward movement of the battens, but permit them to move from one side of the luff sleeve to the other as the apparatus switches between tacks. This is achieved by the location of a point on the batten near but not at the leading end thereof with respect to the mast such that that point can rotate while allowing the remaining leading end portion to shift laterally with respect to the mast. Primarily, this enables the batten to align itself with the leeward side of the sail closer to the mast than was previously possible, and can assure a smooth contour for the sail and luff sleeve around the mast.

In one embodiment of the invention, a coupling between the mast and the batten has a collar for engaging and at least partially surrounding the mast, and from which a single leg extends. A batten is attached or connected to the leg near its distal end so as to prevent forward movement thereof, and the leg is shaped such that the leading end portion of the batten, between the collar and the distal end of the leg, can move laterally to either side thereof when the leg is bent with respect to the collar. The batten can be attached to the leg above or below the main body thereof, or alternatively the leg may pass on either side of an opening into which the leading end of the batten extends. A wide variety of attachment mechanisms may be used. In one alternative to actual attachment, the leading end of the batten may be received in a flexible loop or strap, the end of which is free for lateral movement. In another, shoulders on the batten can abut against parts of the leg to prevent forward movement thereof.

In another embodiment, the leg is itself hingedly mounted on the collar such that the hinge axis will move laterally with respect to the mast to the leeward side when the sail is filled. In this case, the leg may be formed with a slot for receiving the leading end of the batten, but because of the lateral shifting of the hinge substantial alignment of the batten with the leeward side of the sail right up to the leading extremity of the batten can be achieved. Abutment surfaces on the leg and collar can limit the rotational movement of the leg about the hinge, and this has the additional advantage of rigidifying the camber of the respective batten on either tack.

In couplings of the invention, the collar and leg may be formed in two separate parts, the coupling only being assembled when the sail is fitted to a mast. Indeed, the leg may be secured on the sail such that when the batten is fitted thereto from the leech edge there is no difficulty in feeding it to an appropriate slot in the leg. The leg can then be a snap-fit on the collar, this step being completed either before or as the sail is fitted to the mast. The snap-fit can define a fixed or an hinged mounting.

BRIEF DESCRIPTION OF THE DRAWINGS

Various features and advantages of the invention will become apparent from the following description of preferred embodiments thereof. In the description reference will be made to the accompanying drawings. In the drawings.

DESCRIPTION OF THE PREFERRED EMBODIMENTS

Figure 1:
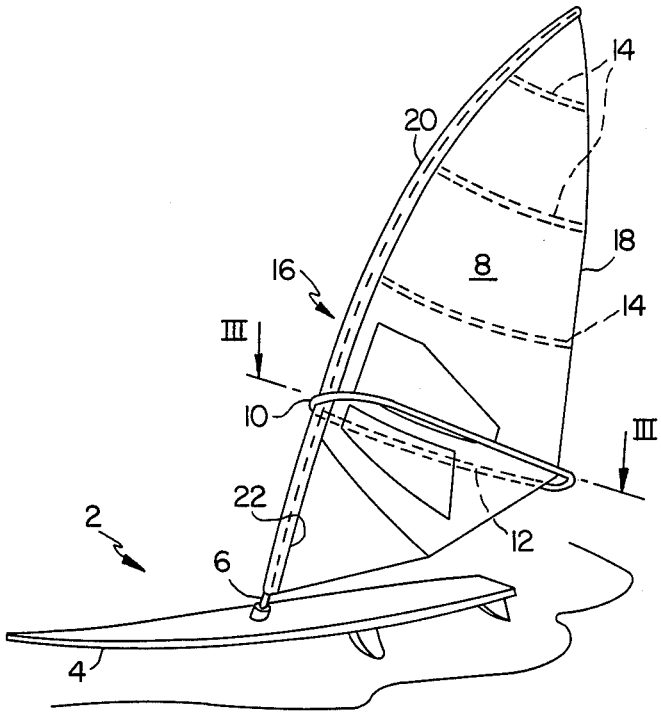
FIG. 1 is an isometric view of a windsurfer constructed in accordance with the teachings of this invention.

FIG. 1 shows a windsurfer 2 which generally comprises a support in the form of a surf-board 4, mast 6 coupled to the support and projecting generally upwards therefrom, a sail 8 and a boom 10 coupled to the mast. In the embodiment illustrated, the boom 10 is a wishbone boom having two arms 12 on opposite sides of the sail 8. The sail 8 is stiffened, and its shape is controlled at least in part, by battens 14.

Figure 2:
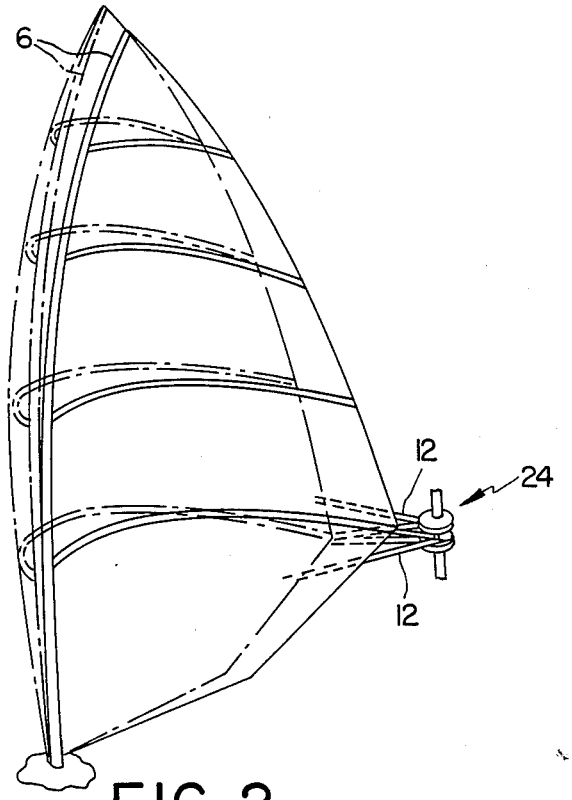
FIG. 2 is another isometric view showing flex wing apparatus according to the invention, and one means for adjusting the camber thereof.

The sail 8 has a leading edge or luff 16, a trailing edge or leech 18, and a luff sleeve 20 along its leading edge. As shown at 22, the sleeve 20 is shown onto the main portion of the sail 8. The mast 6 is received in the sleeve 20, as better shown in FIGS. 3 and 8, and the sail 8 may be rigged in accordance with conventional practice. Except for the construction adjacent and within the sleeve 25, the overall construction of the windsurfer 2 is conventional. The mast 6 is typically a cylindrical resilient construction of fibreglass or aluminium. As shown in FIG. 1, the mast curves rearwardly as it extends upwardly. Such masts are known, and the curvature thereof can be induced by tensioning the sail 8 by using a conventional outhaul 24 as is shown in FIG. 2 which couples the sail to the boom. Thus, the outhaul 24 controls the tension in the sail 8 and the deflection of the mast 6. The more the mast deflects with increase in the outhaul tension, the flatter the sail i.e., the camber is reduced. The mast curvature can also be altered by the provision of an adjustable downhaul which acts either directly on the mast within the sleeve 20, or on the sleeve 20 of the sail 8 at the base of the mast.

Each of the battens 14 is carried by suitable pockets in the sail 8 in the usual manner. The battens will normally be inserted into the sail from the leech, and the trailing end of each batten is suitably secured by a tensioning device, a simple example of which is shown at 26 in FIG. 9. Each batten will normally taper towards its leading end so as to promote maximum curvature in the sail proximate the mast.

Between the leading end of each batten 14 and the mast 6 is located a coupling 28. As will be apparent, each coupling 28 is quite independent of the other couplings and provides a separate support for each batten 14 with respect to the mast. Thus, in use each batten and associated coupling is independently rotatable about the mast and can take up their own orientation with respect to the mast determined by the camber of each batten in the sail which in turn is determined by the setting of the sail, outhaul tension and curvature or flexibility of the mast, and the prevailing wind conditions.

Figure 5:
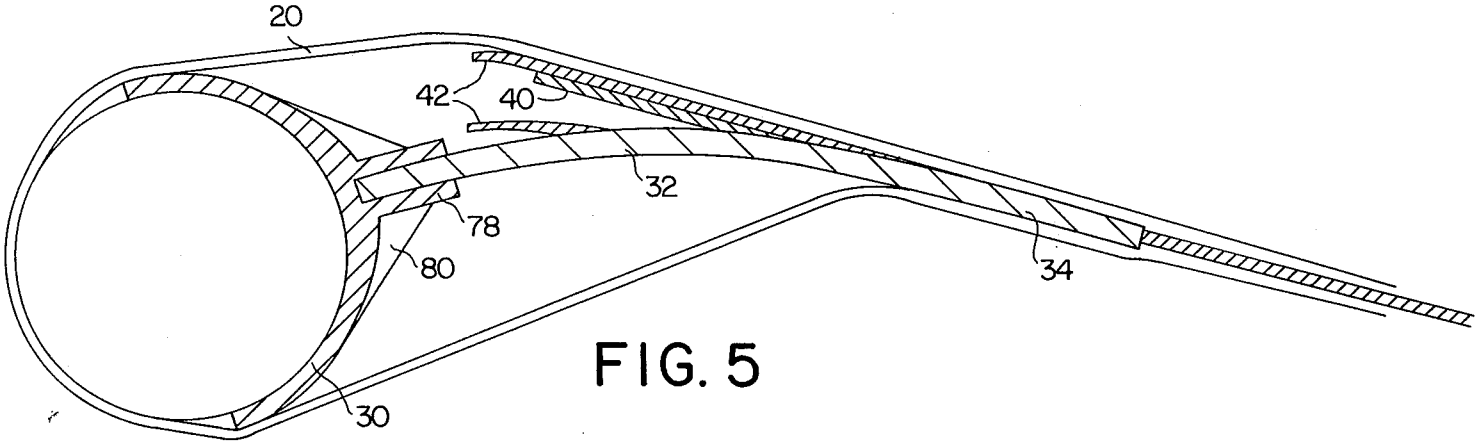
FIG. 5 is an enlarged view similar to that of FIG. 4, but showing a modification of the coupling, and distorted as it would normally be when the associated sail is filled.
Figure 6:
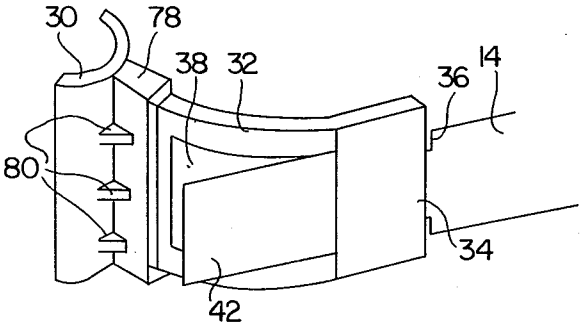
FIG. 6 is an isometric view of the coupling illustrated in FIG. 5 in its deflected condition.
Figure 7:
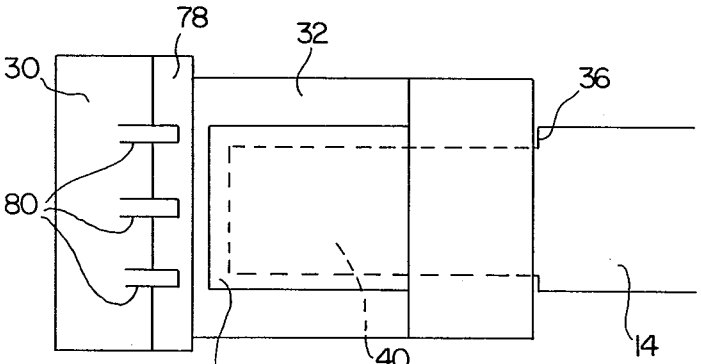
FIG. 7 is an elevation of the coupling of FIG. 6 in the relaxed state.

FIGS. 3 to 7 illustrate how one form of coupling according to the invention functions in the flex wing apparatus illustrated. Each coupling 28 has a collar 30 and a leg 32, the coupling being integrally moulded in a suitable plastics material such as polyurethane. It should be noted though, that the leg 32 and collar 30 may be separate components, and the leg mounted on the collar by an inflexible connection at the root of the leg 32, such as shown in FIGS. 5 to 7 where the collar 30 is extended to form a slot 78 supported by flanges 80, which receives the proximal end of the leg 32. The coupling partially surrounds and engages the mast 6, and the batten 14 extends forwardly from a suitable batten pocket to engage a slot 34 formed at the distal end of the leg 32. As shown in FIGS. 6 and 7, the batten 14 is formed with shoulders 36 which abut against the edges of the slot 34 to prevent the batten from moving through the slot beyond the level of the shoulders 36. With the batten resiliently held against rearward movement by the fixing device 26 at the leech of the sail (see FIG. 9), once rigged the batten is securely held in the sail, and the coupling properly located on the mast. The slot 34 will of course, prevent the coupling 28 from shifting out of place.

Also as shown in FIGS. 6 and 7, the leg 32 has an opening 38 between the slot 34 and the proximal end thereof into which the free end 40 of the batten 14 extends. This opening 38 is covered by a flap 42 on either side. Thus, when the leg 32 is distorted as shown in FIGS. 3 and 5, the free end 40 of the batten moves laterally to one side of the opening 38, against the respective flap 42, which in turn engages the inside surface of the luff sleeve 20.

Figure 3:
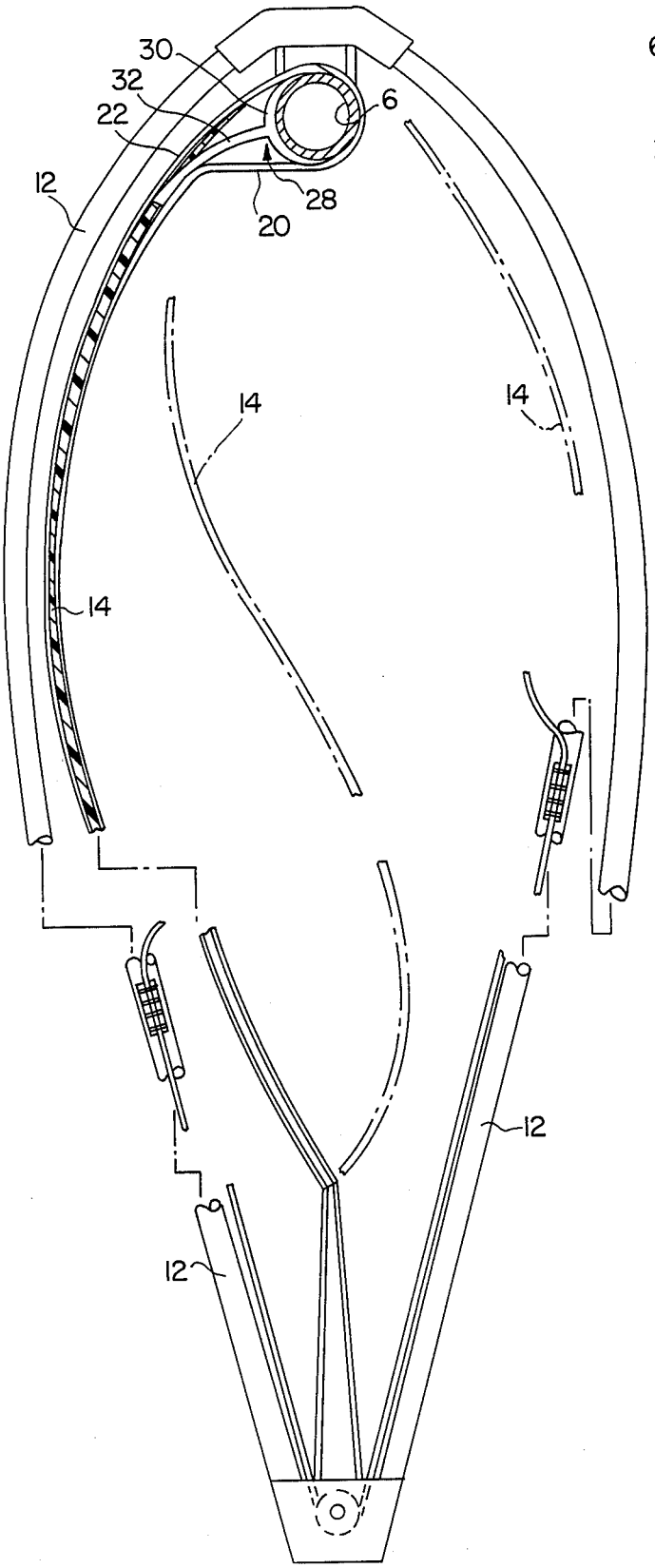
FIG. 3 is an enlarged sectional view taken generally along line III—III of FIG. 1.
Figure 4:
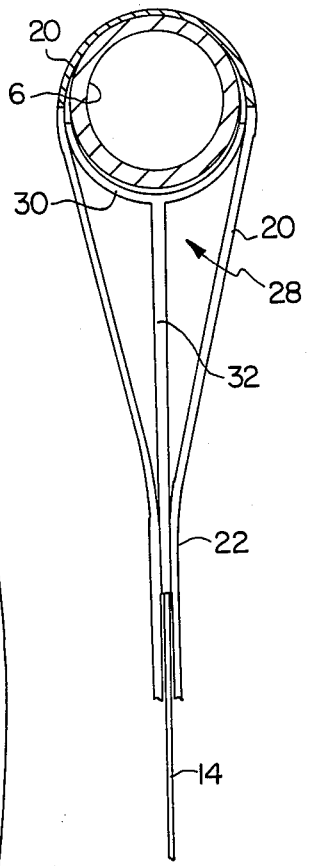
FIG. 4 is a sectional view showing the coupling between the mast and a batten within the luff sleeve of a sail, with the coupling in a relaxed state.

When the apparatus shifts from the tack illustrated to the other, the batten will bend in the manner shown in dotted outline in FIG. 3 as the coupling 28 moves from the orientation shown to a similar orientation on the other tack. During this movement, the slot 34 will rotate relative to the main body of the leg 32, and the free end 40 of the batten 14 will pass through the opening 38, engage the opposite flap 42, and move into a position substantially aligned with the opposite side of the luff sleeve 20.

The attachment of the batten 14 to the leg 32 may of course be accomplished in a number of ways as mentioned above. That illustrated is only one example. Other examples include the formation of the leg in a L-shape with the batten attached to one leg thereof; and the formation of the slot in two halves, one of which is attached to the batten and can be secured to the other by a snap-fit, which also locks the batten in place. Another possibility is the formation of holes in the batten end, and the provision of pins in the walls of the slot to specifically locate the batten therein. However, the shoulder-locking system illustrated has the advantage of enabling the lateral external surfaces of the slot to be smooth, thereby ensuring an even flow of air around the sail.

Figure 10:
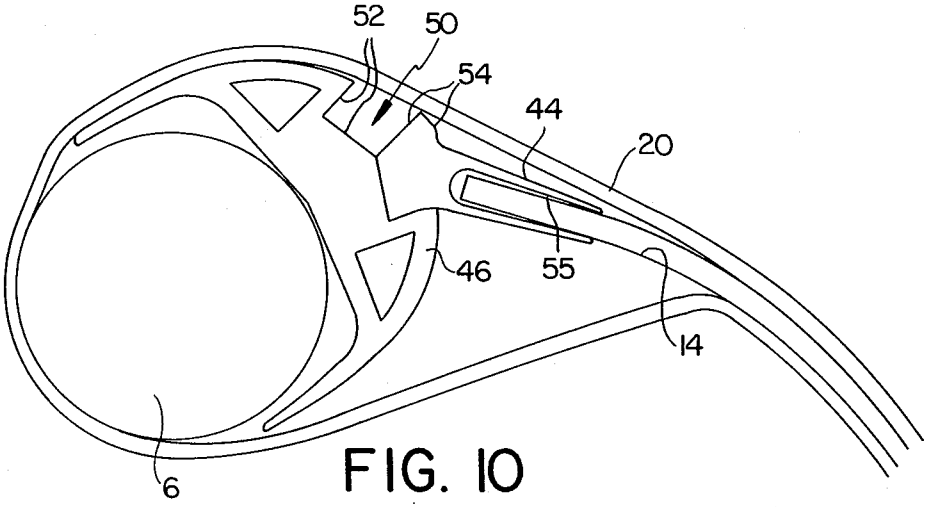
FIG. 10 is a view similar to FIG. 5, but showing the coupling of FIGS. 8 and 9.
Figure 8:
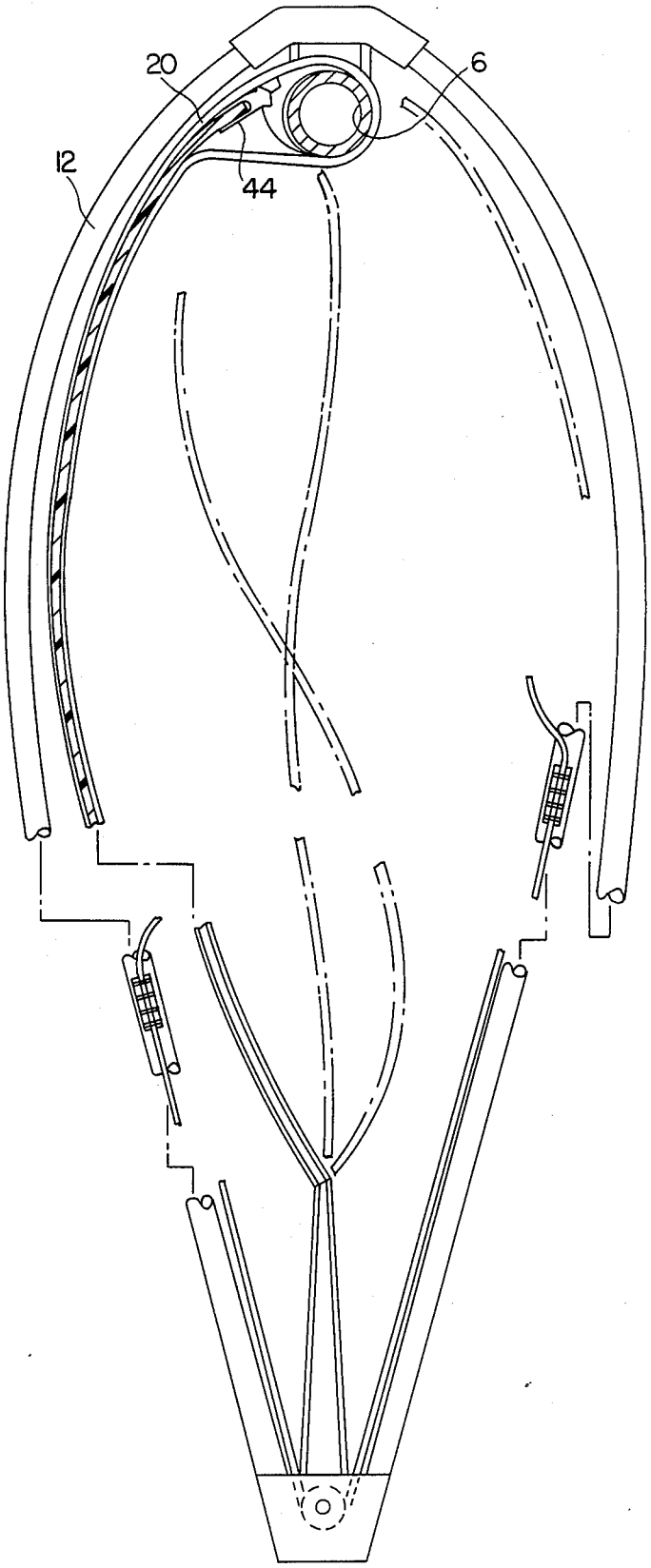
FIG. 8 is a sectional view similar to that of FIG. 3, but illustrating another form of coupling according to the invention.
Figure 9:
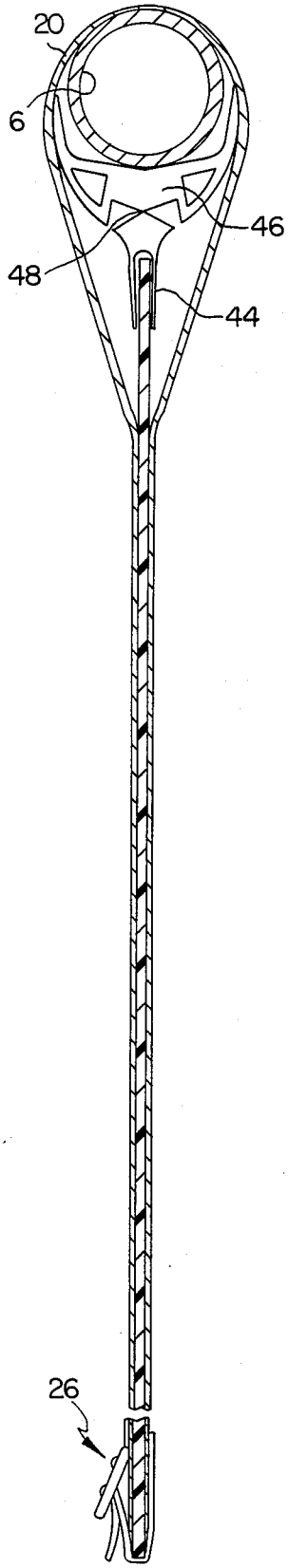
FIG. 9 is a view similar to FIG. 4, but showing the coupling of FIG. 8 and the manner of securement of the batten to the sail near the leech.

FIGS. 8 to 10 show another form of coupling according to the invention in which the leg 44 is hingedly mounted on the collar 46. In the coupling illustrated in these figures, the coupling is formed in a single moulding with a plastic hinge 48 between the leg and collar. In the position shown in FIG. 8, it will be seen that the batten 14 extends further than it does in the apparatus of FIG. 3. This is possible primarily because the coupling in this case is able to accommodate a greater rotation of the leg 44 with respect to the collar 46. As can be seen, the collar 46 has rotated further around the mast 6 in FIG. 8 than has collar 30 in FIG. 3. This also enables the batten 14 to align itself and support the luff sleeve 20 over a greater area than is possible in the embodiment of FIG. 3.

As is more clearly shown in FIG. 10, the hinge 48 is disposed within a slot 50 on the collar 46, and the slot 50 is bounded by abutment walls 52. Complementary surfaces 54 are formed on the leg 44 such that the limit of rotation of the leg 44 about the hinge 48 is strictly defined on either side. By this means, the camber available in a particular sail can be accurately predicted.

Because of the extended rotation of the collar 46 and the lateral shifting of the hinge 48, the embodiment of FIGS. 8 to 10 does not require the leading extremity of the batten to be free for engagement with the luff sleeve. As can be seen from FIG. 10, the leeward surface of the leg 44 forms with the collar 46 and the mast 6 a substantially continuous convex surface which is aligned with and can support the luff sleeve 20. The end of the batten in this embodiment can thus be received in a slot or recess 55 of the leg 44, and is able to shift laterally with respect to the mast by virtue of the counter-rotation of the collar about the mast and the leg about the collar.

Figure 11:
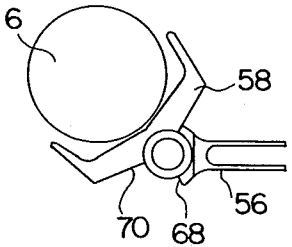
FIG. 11 shows yet another form of coupling according to the invention in its deflected state.
Figure 12:
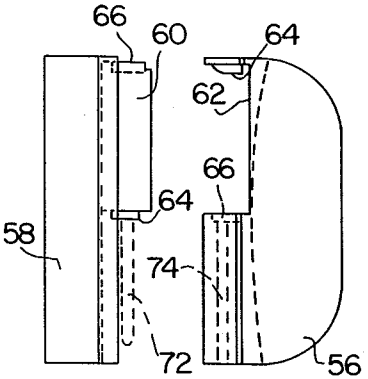
FIGS. 12 and 13 show the coupling of FIG. 11 in elevation and plan, and in its two constituent parts.
Figure 13:
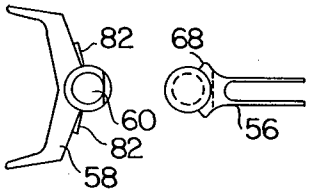

The coupling shown in FIGS. 11 to 13 operates in a manner similar to that of FIGS. 8 to 10, but differs essentially in that the leg 56 and collar 58 are separate parts. As shown in FIG. 12 the collar 58 is formed with a boss 60, and the leg 56 with a recess 62 adapted to receive the boss 60. Projections 64 and recesses 66 are formed respectively on the boss 60 and the walls of the recess 62, which are made of a resilient material such that they can be joined together by means of a resilient snap-fit. The projections and recesses are aligned such that when the parts are assembled a pivotal or hinge axis is defined thereby. Thus, the movement of the leg and collar about the mast when the apparatus is in use is substantially the same as that of the coupling illustrated in FIGS. 8 to 10. Abutment surfaces 68 and 70 define the limits of rotation of the leg about the collar and as with the earlier embodiment, the leg is provided with a slot or recess which receives the end of the respective batten.

In an alternative to the snap-fit described above, the collar might be formed with a pintle 72 to be received in a bore 74 (both shown in dotted outline in FIG. 12) to define the hinge axis. This arrangement has certain advantages, particularly where the coupling is to be subject to high loadings, but assembly of such a coupling in the flex wing apparatus becomes more complex.

A particular advantage of the couplings shown in FIG. 5 and FIGS. 11 to 13 is that the leg 32 or 56 can be permanently attached to the sail 8 at the leading end of each batten pocket. This simplifies the fitment of the leg to the collar as the sail is mounted on the mast, and of course ensures that the leading end of the batten is properly received in the leg 56.

Another advantage of having the collar detachable from the leg is that it enables the apparatus to be used without the battens being coupled to the mast in the manner described. This enables the apparatus to be used effectively with different batten mounting mechanisms. The handling of the apparatus can be more difficult with the couplings fitted than it is without, and for weaker or less experienced sailors this can be a major problem. Thus, by providing each coupling in two parts the same apparatus is suitable for use by sailors of widely different ability.

Yet another advantage of the couplings being in two parts is the possibility of replacement of the legs or the use of different legs in the same coupling. Thus, the flexibility of a particular leg for a particular coupling may be selected for a specific batten in the sail or for particular wind conditions in the embodiments of FIG. 5, or the limits of rotation of the leg with respect to the collar may be altered by the substitution of a leg with a different orientation of abutment surfaces 68 in the embodiment of FIGS. 11 to 13. Alternatively, provision may be made for altering the permitted rotation of the leg about the collar in any of the hinged coupling embodiments of FIGS. 8 to 13 by the location of shims 82 on one or more of the abutment surfaces as shown in dotted outline in FIG. 13. Normally, the maximum permitted rotation of the leg about the collar will be around 120°, but other limits may be suitable under certain conditions.

As with the embodiment of FIGS. 3 to 7, the slot in the legs of the couplings shown in FIGS. 8 to 13 is normally closed at its upper and lower edges to prevent the coupling from becoming disconnected from the respective batten. Different mechanism may also be employed to limit the forward movement of the batten with respect to a leg, or to secure a batten more firmly with respect to a leg. A number of possible mechanisms will be readily apparent to those skilled in the art.

Figure 14:
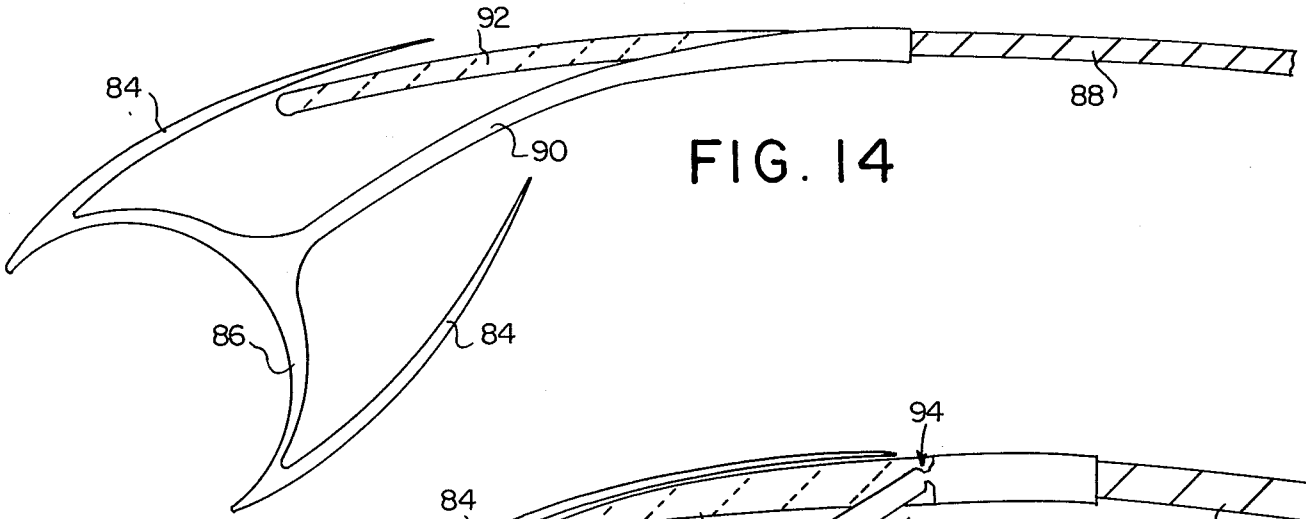
FIGS. 14 and 15 show yet further forms of coupling according to the invention in their deflected state.
Figure 15:
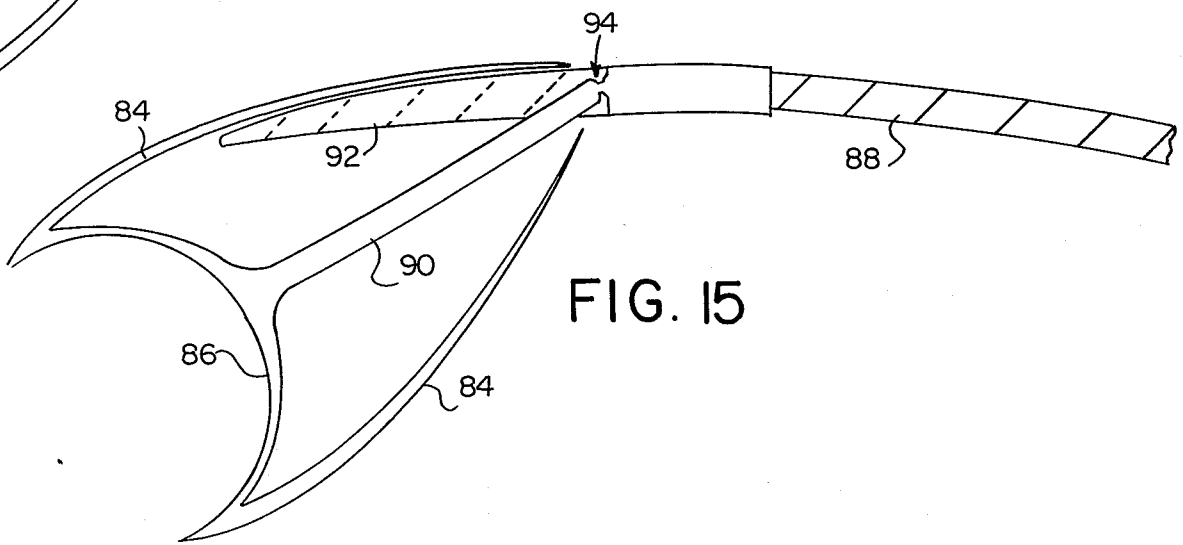

FIGS. 14 and 15 show two further embodiments of the invention in which fairing arms 84 extend rearwardly from either side of a collar 86 to form a smooth surface around the mast and coupling to the batten 88 for engagement with the leeward side of the sail when the coupling is deflected. The FIG. 14 embodiment is similar to that of FIG. 4, although the leg 90 may of course be separate from the collar 86 as in FIGS. 5 to 7, and the end of the batten is retained in a sock or loop 92 secured at its open end to the leg 90. In each embodiment the leg 90 has an opening therein to permit passage of the batten end and sock 92 therethrough as the coupling switches from one tack to the other, generally as described with reference to FIGS. 5 to 7.

The embodiment of FIG. 15 differs from that of FIG. 14 in that the leg 90 is provided with an hinge 94 rather than being resiliently flexible. In this case it will be seen that the fairing arms 84 contribute more directly to the definition of the limits of rotation of the hinge 94, and as with the embodiments of FIGS. 10 to 13, allow greater rotation of the collar 86 about the mast, and thus an increased camber of the sail adjacent thereto. The leg 90 can also flex in this embodiment to create even greater camber proximate the mast, but its mounting on the collar can be reinforced by flanges such as those shown at 80 in FIGS. 5 to 7 to resist such flexure if desired.

Couplings according to the invention will normally be moulded parts formed in a suitable plastics material, such as polypropelene. Polypropelene is particularly preferred in the formation of the plastic hinges shown in the embodiments of FIGS. 10 and 15.

Under normal circumstances, only one type of coupling will be used in flex wing apparatus according to the invention. However, it is within the ambit of the invention to employ different coupling types in the same apparatus. As the couplings described herein have different characteristics, these differences can be exploited where requirements differ, for example between upper and lower portions of the sail.

The couplings according to the invention and described herein are of a relatively compact construction, and can be used with sails having relatively small luff sleeves. In recent years it has become recognized that flex wing apparatus of the type described in my earlier applications referred to above in which couplings are interposed between the mast and the leading ends of the sail battens offer substantially improved performance compared with apparatus not equipped with such couplings. The present invention enables the benefits of such couplings to be adopted in sails not specifically designed therefor. As a consequence, the couplings of the present invention are particularly, but not exclusively, suitable for use with existing sails to improve the performance thereof.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A flex wing comprising a mast, a sail of flexible material having a leading edge and a trailing edge and a luff sleeve at its leading edge, the sail being mounted on the mast by means of the luff sleeve enclosing the mast; a plurality of resilient battens, and means on the sail for carrying the battens with the battens extending towards the leading edge of the sail; coupling means for coupling the battens to the mast for pivotal movement of the battens about the mast, the coupling means including a plurality of couplings of which each coupling comprises a collar for engaging and at least partially surrounding the mast, and a leg extending therefrom for connection to a respective batten end; each coupling allowing pivotal movement between the collar and the end of a batten connected to said leg thereof such that said batten end can move laterally with respect to the mast to align itself with the leeward side of the luff sleeve on either tack.

2. A flex wing according to claim 1 wherein each batten end is connected to the leg of a coupling such that at the point of connection it is aligned with a portion thereof at all times, the leg being flexibly attached to the collar to permit relative pivotal movement between said portion and the collar.

3. A flex wing according to claim 1 wherein the point of connection of the leg of each coupling to the respective batten end is remote from the collar and the leading extremity of the batten, and wherein the leg is resiliently flexible therebetween.

4. A flex wing according to claim 3 wherein each leg is removably mounted on the respective collar.

5. A flex wing according to claim 3 wherein the leg is formed with a central opening between said point of connection and the collar, the batten end extending into said opening and being movable through said opening upon flexure of the leg.

6. A flex wing comprising a mast, a sail of flexible material having a leading edge and a trailing edge and a luff sleeve at its leading edge, the sail being mounted on the mast by means of the luff sleeve enclosing the mast; a plurality of resilient battens, and means on the sail for carrying the battens with the battens extending towards the leading edge of the sail; coupling means for coupling the battens to the mast for pivotal movement of the battens about the mast, the coupling means including a plurality of couplings of which each coupling comprises a collar for engaging and at least partially surrounding the mast, and a resilient leg extending radially therefrom and attached to a respective batten end at a point spaced from the collar and from the leading extremity of the batten such that the batten end extends from the point of attachment to the collar towards the collar, the leg defining an opening between the collar and said point of attachment for receiving the batten end, wherein the leg is adapted to flex and permit the respective batten end to align itself with the leeward side of the luff sleeve of the sail on either tack, said opening permitting passage of the batten end therethrough as the sail switches from one tack to the other.

7. A flex wing according to claim 2 wherein the leg of each coupling is hingedly mounted on the respective collar, the axis of the hinge being substantially parallel to that of the mast.

8. A flex wing according to claim 7 wherein each leg is permanently mounted on the respective collar.

9. A flex wing according to claim 7 wherein each leg is removably mounted on the respective collar.

10. A flex wing according to claim 7 wherein each collar is formed with a slot in which the leading end of the respective leg is received, the axis of said hinge being defined within said slot.

11. A flex wing comprising a mast, a sail of flexible material having a leading edge and a trailing edge and a luff sleeve at its leading edge, the sail being mounted on the mast by means of the luff sleeve enclosing the mast; a plurality of resilient battens, and means on the sail for carrying the battens with the battens extending toward the leading edge of the sail; coupling means for coupling the battens to the mast for pivotal movement of the battens about the mast, the coupling means including a plurality of couplings of which each coupling comprises a collar for engaging and at least partially surrounding the mast, and a leg extending therefrom for connecting to a respective batten end; each coupling allowing pivotal movement between the collar and the end of a batten connected to said leg thereof such that said batten end can move laterally with respect to the mast to align itself with the leeward side of the luff sleeve on either tack; each batten end being connected to the leg of a coupling such that at the point of connection it is aligned with a portion thereof at all times, the leg being flexibly attached to the collar to permit relative pivotal movement between said portion and the collar, the leg of each coupling being hingedly mounted on the respective collar, and the axis of the hinge being substantially parallel to that of the mast; each collar being formed with a slot in which the leading end of the respective leg is received, the axis of said hinge being defined within the slot; and the respective cross-sections of the end of the leg and the slot defining a range of possible rotation of the leg about said hinge between specified limits.

12. A flex wing according to claim 11 wherein the slot has a pair of convergent surfaces at either side thereof and wherein the end of the leg has a complementary pair of surfaces on either side thereof, said limits of rotation being defined by the mutual abutment of said surfaces.

13. A flex wing according to claim 8 or claim 9 wherein each leg is formed with a slot for receiving the batten end.

14. A flex wing comprising a mast, a sail of flexible material having a leading edge and a trailing edge and a luff sleeve at its leading edge, the sail being mounted on the mast by means of the luff sleeve enclosing the mast; a plurality of resilient battens, and means on the sail for carrying the battens with the battens extending towards the leading edge of the sail; coupling means for coupling the battens to the mast for pivotal movement of the battens about the mast, the coupling means including a plurality of couplings of which each coupling comprises a collar for engaging and at least partially surrounding the mast, and a leg hingedly mounted thereon and extending laterally from the mast with a slot to receive a respective batten end, each coupling allowing rotational movement of the leg about the axis of the hinge between limits defined by complementary abutment surfaces on the leg and collar, the leg at each said limit being substantially aligned with the external surface of the collar to define a substantially continuous convex surface around the mast and coupling.

15. A flex wing comprising a mast, a sail of flexible material having a leading edge and a trailing edge and a luff sleeve at its leading edge, the sail being mounted on the mast by means of the luff sleeve enclosing the mast; a plurality of resilient battens, and means on the sail for carrying the battens with the battens extending toward the leading edge of the sail; coupling means for coupling the battens to the mast for pivotal movement of the battens about the mast, coupling means including a plurality of couplings of which each coupling comprises a collar for engaging and at least partially surrounding the mast, and a leg extending therefrom for connection to a respective batten end; each coupling allowing pivotal movement between the collar and the end of a batten connected to said leg thereof such that said batten end can move laterally with respect to the mast to align itself with the leeward side of the luff sleeve on either tack; each batten end being connected to the leg of a coupling such that at the point of connection it is aligned with a portion thereof at all times, the leg being flexibly attached to the collar to permit relative pivotal movement between said portion and the collar; each leg being removably mounted on the respective collar; each collar having a boss extending radially therefrom; and each leg having a recess for receiving said boss, said hinge axis being defined in said boss and the leg being rotatable about said boss.

16. A flex wing according to claim 15 wherein the collar and leg are formed in a resilient material, the boss and the walls of the recess are formed with complementary projections and recesses, and wherein the leg is mounted on the collar by means of the resilient engagement of the projections and recesses.

17. A flex wing according to claim 15 wherein the boss ad the walls of the recess are formed with aligned openings through which a pin extends to define said hinge axis.

18. A flex wing according to claim 15 wherein the recess on the leg is defined adjacent an extension thereof having an hole therein, the boss having a pintle extending therefrom and received in said hole to define said hinge axis.

19. A flex wing according to claim 15 wherein each collar and each leg is formed with abutment surfaces which define the limits of permitted rotation of the leg about said hinge axis.

20. A flex wing according to claim 12 or claim 19 wherein at each limit of permitted rotation the leg of each coupling is substantially aligned with the external surface of the collar to define a substantially continuous convex surface around the mast and coupling.

21. A flex wing comprising a mast, a sail of flexible material having a leading edge and a trailing edge and a luff sleeve at its leading edge, the sail being mounted on the mast by means of the luff sleeve enclosing the mast; a plurality of resilient battens, and means on the sail for carrying the battens with the battens extending toward the leading edge of the sail; coupling means for coupling the battens to the mast for pivotal movement of the battens about the mast, the coupling means including a plurality of couplings of which each coupling comprises a collar for engaging and at least partially surrounding the mast, and a leg extending therefrom for connection to a respective batten end; each coupling allowing pivotal movement between the collar and the end of a batten connected to said leg thereof such that said batten end can move laterally with respect to the mast to align itself with the leeward side of the luff sleeve on either tack; the point of connection of the leg of each coupling to the respective batten end being remote from the collar and the leading extremity of the batten and the leg being resiliently flexible therebetween; each leg being removably mounted on the respective collar; and the leg of each coupling is attached to the sail.

22. A flex wing comprising a mast, a sail of flexible material having a leading edge and a trailing edge and a luff sleeve at its leading edge, the sail being mounted on the mast by means of the luff sleeve enclosing the mast; a plurality of resilient battens, and means on the sail for carrying the battens with the battens extending towards the leading edge of the sail; coupling means for coupling the battens to the mast for pivotal movement of the battens about the mast, the coupling means including a plurality of couplings of which each coupling comprises a collar for engaging and at least partially surrounding the mast, and a leg removably and hingedly mounted thereon, one of the collar and leg having a boss and the other of the collar and leg defining a recess for receiving said boss, the engagement between the boss and recess defining said hinged mounting permitting rotation of the leg with respect to the collar about the axis of the hinge; and wherein the leg and collar of each coupling are formed with complementary abutment surfaces which define the limits of such permitted rotation, the leg, the collar and the mast defining at each said limit a substantially continuous convex surface for engagement by the leeward side of the luff sleeve on either tack.

23. A flex wing according to claim 1 wherein each coupling includes a pair of fairing arms extending on either side of the leg to form with the mast and respective batten a substantially smooth continuous surface for engagement by the leeward side of the luff sleeve on either tack.

24. A coupling for use in the flex wing of claim 1 comprising a collar for engaging and at least partially surrounding the mast thereof, and a leg extending laterally therefrom, the leg having a connector spaced from the collar for connection to a batten in the sail thereof, wherein the leg is mounted on the collar to accommodate rotation of the connector and lateral movement of a batten connected thereto with respect to the collar, the connection maintaining the end of a batten spaced from the collar at all times.

25. A coupling for use in the flex wing of claim 1 comprising a collar for engaging and at least partially surrounding the mast thereof, and a leg extending laterally therefrom, the leg having a connector spaced from the collar for connection to a batten in the sail thereof wherein the leg is mounted on the collar to accomodate rotation of the connector and lateral movement of a batten connected thereto with respect to the collar, the connection maintaining the end of a batten spaced from the collar at all times, the leg being resiliently flexible and fixedly attached to the collar at its proximal end, the connector being located at its distal end, and the leg having an opening between the connector and the collar permitting the end of a batten attached to the connector to move laterally therethrough as the leg is flexed.

26. A coupling according to claim 24 wherein the leg is hingedly attached to the collar and rotatable about the axis of the hinge between specified limits.

27. A coupling according to claim 24 wherein the leg is removably attached to the collar.

28. A coupling according to claim 24 including a pair of fairing arms extending on either side of the leg to form with the mast and respective batten a substantially smooth continuous surface for engagement by the leeward side of the luff sleeve on either tack.

29. A flex wing comprising a mast, a sail of flexible material having a leading edge and a trailing edge and a luff sleeve at its leading edge, the sail being mounted on the mast by means of the luff sleeve enclosing the mast; a plurality of resilient battens, and means on the sail for carrying the battens with the battens extending toward the leading edge of the sail; coupling means for coupling the battens to the mast for pivotal movement of the battens about the mast, the coupling means including a plurality of couplings of which each coupling comprises a collar for engaging and at least partially surrounding the mast, and a leg extending therefrom for connection to a respective batten end; each coupling allowing pivotal movement between the collar and the end of a batten connected to said leg thereof such that said batten end can move laterally with respect to the mast to align itself with the leeward side of the luff sleeve on either tack; each batten end being connected to the leg of a coupling such that at the point of connection it is aligned with a portion thereof at all times, the leg being flexibly attached to the collar to permit relative pivotal movement between said portion and the collar; each leg being removably mounted on the respective collar; and the leg of each coupling being attached to the sail.

* * * * *